US010266967B2

(12) United States Patent
Hahm et al.

(10) Patent No.: US 10,266,967 B2
(45) Date of Patent: Apr. 23, 2019

(54) METHOD AND APPARATUS FOR FABRICATING CONJUGATE FIBER, AND CONJUGATE FIBER FABRICATED THEREBY

(71) Applicant: KOREA INSTITUTE OF INDUSTRIAL TECHNOLOGY, Cheonan-si (KR)

(72) Inventors: Wan-Gyu Hahm, Yongin-si (KR); Sung Won Byun, Seoul (KR); Byeong Jin Yeang, Suwon-si (KR); In Woo Nam, Seoul (KR); Seung Jin Lee, Seoul (KR); Do Gun Kim, Ansan-si (KR); Ki Sub Lim, Incheon (KR)

(73) Assignee: KOREA INSTITUTE OF INDUSTRIAL TECHNOLOGY, Cheonan-si (KR)

( * ) Notice: Subject to any disclaimer, the term of this patent is extended or adjusted under 35 U.S.C. 154(b) by 627 days.

(21) Appl. No.: 14/432,680

(22) PCT Filed: Sep. 11, 2013

(86) PCT No.: PCT/KR2013/008225
§ 371 (c)(1),
(2) Date: Mar. 31, 2015

(87) PCT Pub. No.: WO2014/065507
PCT Pub. Date: May 1, 2014

(65) Prior Publication Data

US 2015/0240385 A1 Aug. 27, 2015

(30) Foreign Application Priority Data

Oct. 22, 2012 (KR) ..... 10-2012-0117320

(51) Int. Cl.
*D01D 4/06* (2006.01)
*D01D 5/32* (2006.01)
(Continued)

(52) U.S. Cl.
CPC ..... *D01D 5/30* (2013.01); *D01D 4/06* (2013.01); *D01D 5/32* (2013.01); *D01F 8/04* (2013.01);
(Continued)

(58) Field of Classification Search
CPC ..... D01D 4/06; D01D 5/30; D01D 5/32
See application file for complete search history.

(56) References Cited

U.S. PATENT DOCUMENTS 2,815,033 A * 12/1957 Braunlich ..... D01D 5/28 137/7
3,049,397 A * 8/1962 O'Shaughnessy ..... D01D 5/253 137/625.42
(Continued)

FOREIGN PATENT DOCUMENTS

JP 1973-042258 B2 12/1973
JP 55-112307 A 8/1980
(Continued)

OTHER PUBLICATIONS

Masuda, et al.; "Effect of the Control of Polymer Flow in the Vicinity of Spinning Nozzle on Mechanical Properties of Poly-(ethylene terephthalate) Fibers"; Hansler-Elibrary; Department of Organic and Polymeric Materials, Graduate School of Engineering, Tokyo Institute of Technology; Tokyo, Japan (Abstract); International Polymer Processing: vol. 25, No. 2, pp. 159-159 (May 2010).
(Continued)

*Primary Examiner* — Yogendra N Gupta
*Assistant Examiner* — Joseph S Leyson
(74) *Attorney, Agent, or Firm* — Walter | Haverfield LLP; Sean F. Mellino; D. Peter Hochberg

(57) ABSTRACT

A method and apparatus for fabricating a conjugate fiber. Resins having different properties, for example, resins of the same or different components including functional pigments
(Continued)

or substances are continuously and alternatively discharged in an endless state by operating a spinning nozzle unit in a melting state, thereby fabricating the conjugate fiber having the different properties in the longitudinal direction of the fiber, and having various surface effects and patterns in the longitudinal direction of the fiber. A conjugate fiber fabricated by the above apparatus and method is also provided.

5 Claims, 13 Drawing Sheets

(51) Int. Cl.
*D01D 5/30* (2006.01)
*D01F 8/04* (2006.01)

(52) U.S. Cl.
CPC ..... *D10B 2401/00* (2013.01); *Y10T 428/2929* (2015.01)

(56) References Cited

U.S. PATENT DOCUMENTS

| | | | | |
|---|---|---|---|---|
| 3,272,901 | A * | 9/1966 | Sims | D01D 5/20 264/167 |
| 3,371,139 | A * | 2/1968 | Frazer | D01D 5/32 264/168 |
| 4,005,167 | A * | 1/1977 | Stern | B29C 45/13 264/245 |
| 5,352,106 | A | 10/1994 | Lenk et al. | |
| 5,965,073 | A | 10/1999 | Geier et al. | |
| 6,592,716 | B1 | 7/2003 | Kim et al. | |
| 2004/0126579 | A1 | 7/2004 | Creagan | |
| 2009/0311527 | A1 | 12/2009 | Seo et al. | |

FOREIGN PATENT DOCUMENTS

| | | | |
|---|---|---|---|
| JP | 1980-112307 | A | 8/1980 |
| JP | 1989-104813 | A | 4/1989 |
| JP | 1995-300732 | A | 11/1995 |
| JP | 2011174214 | A | 9/2011 |
| KR | 10-1997-0015803 | A | 4/1997 |
| KR | 10-2011-0055447 | A | 5/2011 |

OTHER PUBLICATIONS

International Search report of KIPO dated Nov. 27, 2013.
Written Opinion of the International Searching Authority of KIPO dated Nov. 27, 2013.
International Preliminary Report on Patentability of KIPO dated Apr. 28, 2015.

* cited by examiner

METHOD AND APPARATUS FOR FABRICATING CONJUGATE FIBER, AND CONJUGATE FIBER FABRICATED THEREBY

CROSS-REFERENCE TO RELATED APPLICATIONS

This application is a 371 National Stage application of International Application No. PCT/KR2013/008225 filed on Sep. 11, 2013, which claims priority of Korean application Serial Number 10-2012-0117320 filed on Oct. 22, 2012, both of which are incorporated herein by reference in their entireties.

BACKGROUND OF THE INVENTION

Technical Field

The present invention discloses a method and apparatus for fabricating a conjugate fiber and a conjugate fiber fabricated thereby. More specifically, the present invention relates to a method and apparatus for fabricating a conjugate fiber, of which resins having different properties are continuously and alternatively mixed in a longitudinal direction of the fiber, and a conjugate fiber fabricated thereby.

Background Art

In general, an apparatus for fabricating a conjugate fiber widely known in the art includes, as illustrated in FIG. 1, a plurality of hoppers 1 that supply at least two granular resin materials, a melting extruder 2 that melts and extrudes the granular resin materials supplied from the respective hoppers 1, a metering pump 7 that measures the molten resin supplied from the respective melting extruders 2 by a specific amount per unit time and feeds it to a spinning nozzle unit 3, the spinning nozzle unit 3 that feeds the molten resin supplied from the respective metering pumps 7 via a feed pipe and a distribution plate to spin a fiber W, a cooling unit 4 that cools the fiber W spun from the spinning nozzle unit 3, a roller 5 that stretches and heat-treats the fiber W cooled by the cooling unit 4, and a winder 6 that winds the fiber W stretched and heat-treated by the roller 5.

The conjugate fiber fabricated by the above-described apparatus includes a sheath-core type, a side-by-side, a sea-island type, and so forth. These types of conjugate fibers can be fabricated by differently setting the configuration of the distribution plate and the flow path which are provided in the spinning nozzle unit 3.

FIG. 2 is a cross-sectional view of major parts to illustrate the spinning nozzle unit for fabricating the conjugate fiber of the sea-island type, for example. A spinning nozzle unit 3 for fabricating the conjugate fiber of the sea-island type includes multi-layered distribution plates 11 and 12, and a nozzle plate 13 positioned below the lowermost distribution plate 12. The respective distribution plates 11 and 12 is provided with a plurality of feed pipes 14 and 15 extending in a vertical direction, and the nozzle plate 13 is provided with a spinning nozzle 16 which is connected to the feed pipes 14 and 15. Spaces 17 and 18 are formed between the respective distribution plates 11 and 12 and the nozzle plate 13.

With the above configuration, after two kinds of resins each supplied into the spinning nozzle unit 3 from the molting extruder 2, for example, resin A (island component) and resin B (sea component), flow into the feed pipes 14 and 15 of the distribution plates 11 and 12 and the spaces 17 and 18, the resins are combined in the space 18 of the nozzle plate 13, and then are spun through the spinning nozzle 16 of the nozzle plate 13.

The fiber W spun by the spinning nozzle 16 has a cross sectional shape as follows, as illustrated in FIG. 3: a plurality of resins A (island component) are enclosed by one resin B (sea component). Since such a cross sectional shape is determined by the configuration of the distribution plates 11 and 12 and the feed pipes 14 and 15, the number and configuration of the distribution plates 11 and 12 and the feed pipes 14 and 15 to be installed may be varied to fabricate various types of conjugate fibers. Also, the conjugate fibers having specific cross sectional shapes are fabricated which are widely used in the fabrication of functional clothing, such as waterproof breathable clothing, quick-sweat-absorbing and quick-drying clothing, and microfiber, and which are used for a security yarn so as to prevent bills or certificates from being counterfeited.

According to the method and apparatus for fabricating the conjugate fiber according to the related art, since the specific cross sectional shape of the fiber is constantly maintained in the longitudinal direction of the fiber, composite components cannot be changed in the longitudinal direction of the fiber. Therefore, it is not possible to provide the fiber with various effects (dyeing difference, physical properties (strength, elongation, Young's modulus, boil-off shrinkage or the like), melting point, and so forth) of composite components in the longitudinal direction of the fiber. In particular, in the case of the security yarn using the conjugate fiber for use in the forgery protection of negotiable securities, since anti-forgery components which are different in the longitudinal direction of the fiber exist in parallel, there is a problem of interrupting the expression of security elements due to external stimulus (e.g., change in color or degradation in fluorescent performance). Therefore, it needs to improve such a problem.

DISCLOSURE

Technical Problem

The present invention has been made to solve the above problems, and an object of the present invention provides a method and apparatus for fabricating a conjugate fiber, wherein resins having different properties, for example, resins of the same or different components including at least one selected from functional organic, inorganic, and metal substances are continuously and alternatively discharged in an endless state by operating a spinning nozzle unit in a melting state, thereby fabricating the conjugate fiber having the different properties in the longitudinal direction of the fiber, and having various surface effects and patterns in the longitudinal direction of the fiber; the spinning nozzle unit is operated to arbitrarily set a mixed length of the fiber in the longitudinal direction, thereby fabricating the conjugate fiber having various surface effects and patterns in the longitudinal direction of the fiber which can be used as a high functional fiber and a security yarn. Another object of the present invention provides a conjugate fiber fabricated by the above apparatus and method.

Technical Solution

In order to achieve the above objects, the present invention provides a method for fabricating a conjugate fiber, comprising the steps of: supplying heterogeneous resins having different properties to a spinning nozzle unit by each melting extruder; and continuously and alternatively discharging the respective molten resins supplied from the respective melting extruders by the spinning nozzle unit, thereby spinning the fiber continuously and alternatively formed of the heterogeneous resins having different properties in a longitudinal direction of the fiber.

The heterogeneous resins having the different properties are the same or different resins including at least one selected from functional organic, inorganic, and metal substances so that the resins have different properties.

The functional organic, inorganic, and metal substances include at least one selected from a coloring pigment, a UV-sensitized fluorescent pigment, an IR-sensitized absorption pigment, an X-rays absorption metal substance, an antibiotic substance, a flame retardant substance, and a deodorizing substance.

Also, the present invention provides an apparatus for fabricating a conjugate fiber, comprising: a plurality of hoppers that supply at least two heterogeneous resins of different properties; a plurality of melting extruders that melt and extrude the resin supplied from the respective hoppers; and a spinning nozzle unit that feeds the molten resin supplied from the plurality of melting extruders to spin a fiber, wherein the spinning nozzle unit includes a spinning nozzle body having a plurality of inlet passages which are fed by the molten resins supplied from the respective melting extruders, and a nozzle passage for discharging the molten resin, and an operator having a plurality of connecting passages for connecting the respective inlet passages with the nozzle passage and operating so that the respective connecting passages is alternatively connected with the nozzle passage.

The operator is installed in the spinning nozzle body so that the operator is rotated around a rotating shaft in a forward or reverse direction; the operator has an outer peripheral surface centered on the rotating shaft; the inlet port and the outlet port of the respective connecting passages are positioned on the outer peripheral surface the outlet port of the respective inlet passages and the inlet port of the nozzle passage are positioned to be opposite to the outer peripheral surface of the operator; and the inlet port and the outlet port of the respective connecting passages formed in the operator alternatively and continuously communicate with the outlet port of the respective inlet passages and the inlet port of the nozzle passage as the operator is rotated in the forward or reverse direction.

In addition, the present invention provides a conjugate fiber fabricated by the method described above.

Advantageous Effects

According to the method and apparatus for fabricating the conjugate fiber, the resins of the same or different components including at least one selected from functional organic, inorganic, and metal substances can be continuously and alternatively discharged in an endless state by operating the spinning nozzle unit in a melting state, thereby fabricating the conjugate fiber having the different properties in the longitudinal direction of the fiber.

Since the operating speed and time of the spinning nozzle unit are variously set, it is possible to fabricate the conjugate fiber having various surface effects and patterns in the longitudinal direction of the fiber. Also, since the fiber has the surface effects and patterns in the longitudinal direction of the fiber, the limitation on the surface effects and patterns can be remarkably improved, as compared to the related art which can provide various shapes to the cross section of the fiber.

As described above, the present invention can fabricate the conjugate fiber having various surface effects and patterns in the longitudinal direction of the fiber. Therefore, by setting the operating speed and time of the spinning nozzle unit, it is possible to fabricate the conjugate fiber having a specific surface effect and pattern in the longitudinal direction of the fiber, thereby further improving the function of the fiber and thus preventing bills or certificates from being forged, which can be used as a security yarn.

DETAILED DESCRIPTION OF THE PREFERRED EMBODIMENT

Mode for Invention

An apparatus and method for fabricating a conjugate fiber according to a preferred embodiment of the present invention will be described in detail with reference to the accompanying drawings.

Figure 1:
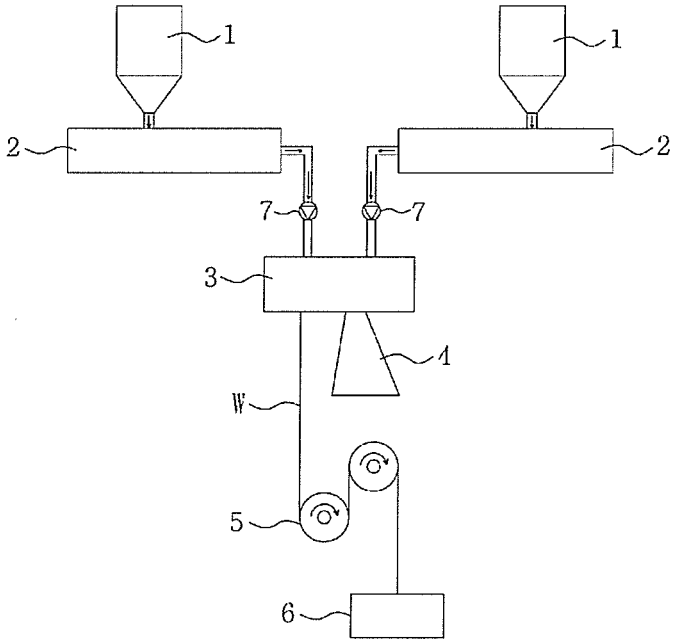
FIG. 1 is a perspective view illustrating the configuration of an apparatus for fabricating a conjugate fiber according to the relate art.
Figure 2:
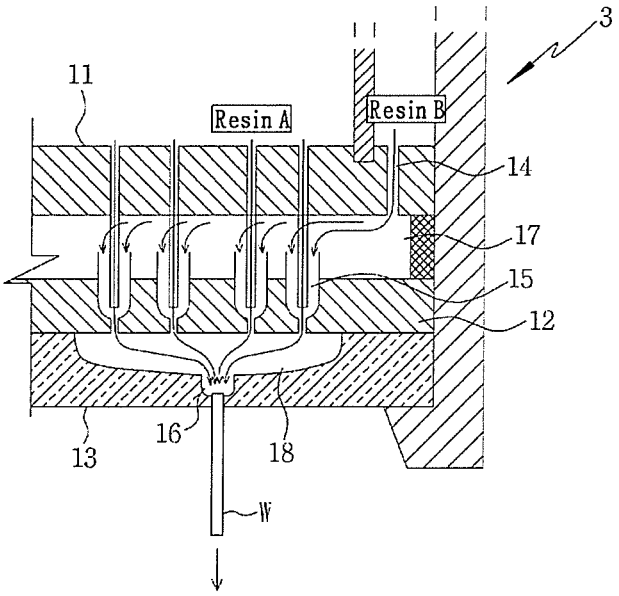
FIG. 2 is a cross-sectional view illustrating major parts of a spinning nozzle unit in the apparatus for fabricating the conjugate fiber according to the relate art.
Figure 3:
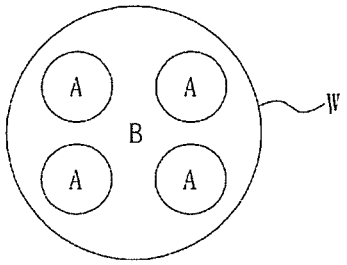
FIG. 3 is a cross-sectional view of the conjugate fiber fabricated by the apparatus according to the relate art.
Figure 4:
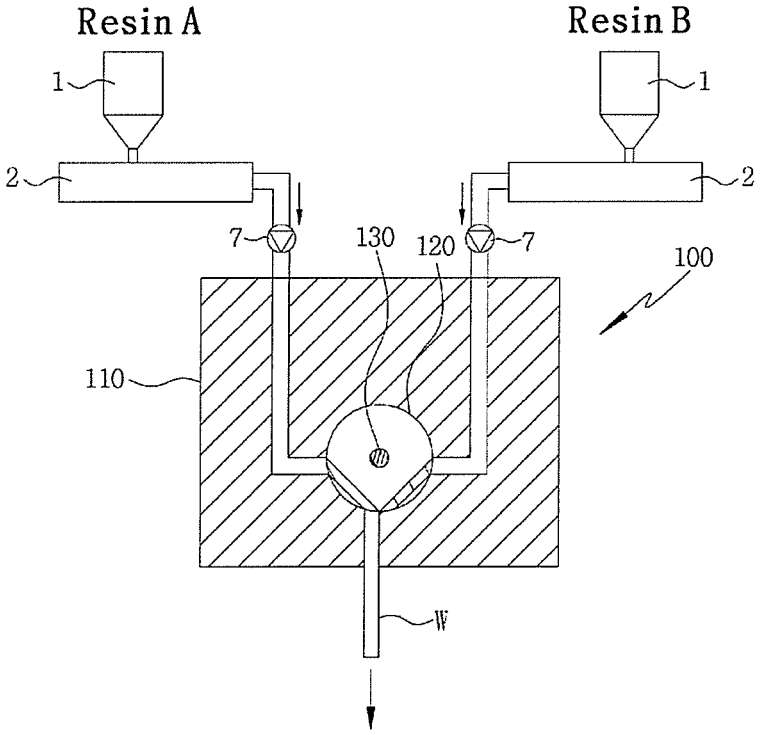
FIG. 4 is a perspective view illustrating the configuration of an apparatus and method for fabricating a conjugate fiber according to the present invention.

FIG. 4 is a perspective view illustrating the apparatus and method for fabricating the conjugate fiber according to the present invention, in which the same reference numerals are indicated to refer to the same elements as those in the related art, and the detailed description of the configuration and operation will be omitted.

The apparatus for fabricating the conjugate fiber according to the present invention includes, as illustrated in the drawing, a plurality of hoppers 1 that supply at least two heterogeneous resins of different properties, a plurality of melting extruders 2 that melt and extrude the resin supplied from the respective hoppers 1, a metering pump 7 that measures the molten resin supplied from the respective melting extruders 2 by a specific amount per unit time and feeds it to a spinning nozzle unit 3, and the spinning nozzle unit 100 that feeds the molten resin supplied from the respective metering pumps 7 to spin a fiber W.

The method for fabricating the conjugate fiber according to the present invention includes a step of supplying the heterogeneous resins having different properties to the spinning nozzle unit 100 by the respective melting extruders 2, and a step of continuously and alternatively discharging the respective molten resins supplied from the respective melting extruders 2 by the spinning nozzle unit 100, thereby spinning the fiber continuously and alternatively formed of the heterogeneous resins having the different properties in a longitudinal direction of the fiber.

The heterogeneous resins having the different properties can employ, for example, resins of the same component including at least one selected from functional organic, inorganic, and metal substances having different properties, or employ resins of different components. The functional organic, inorganic, and metal substances may be at least one selected from coloring pigments, UV-sensitized fluorescent pigments, IR-sensitized absorption pigments, X-rays absorption metal substances, antibiotic substances, flame retardant substances, and deodorizing substances.

Figure 5:
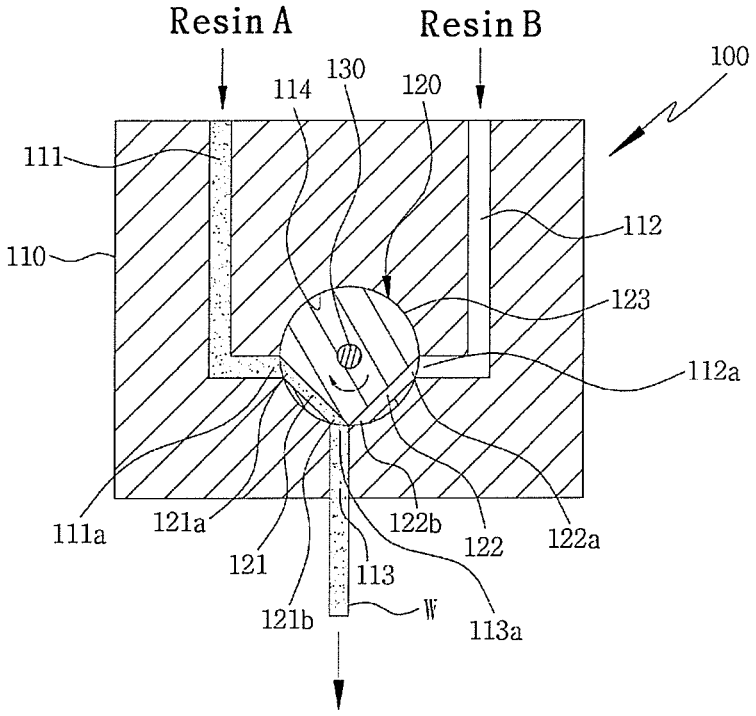
FIGS. 5 to 14 are views illustrating operation of a spinning nozzle unit in the apparatus and method for fabricating the conjugate fiber according to the present invention.

The spinning nozzle unit 100 includes, as illustrated in FIG. 5, a spinning nozzle body 110 having a plurality of inlet passages 111 and 112 which are fed by the molten resins supplied from the respective melting extruders 2, and a nozzle passage 113 for discharging the molten resin, and an operator 120 having a plurality of connecting passages 121 and 122 for connecting the respective inlet passages 111 and 112 with the nozzle passage 113 and operating so that the respective connecting passages 121 and 122 is alternatively connected with the nozzle passage 113.

The operator 120 is installed in the spinning nozzle body 110, and, to this end, the spinning nozzle body 110 is formed with a space portion 114 of a shape corresponding to the operator 120.

The operator 120 is installed in the space portion 114 of the spinning nozzle body 110 so that the operator can be rotated around a rotating shaft 130 in a forward or reverse direction (in other words, in a clockwise or counterclockwise direction). To this end, the operator 120 has an outer peripheral surface 123 centered on the rotating shaft 130, and the space portion 114 of the spinning nozzle body 110 is formed in a circular shape.

The respective connecting passages 121 and 122 of the operator 120 is formed so that inlet ports 121*a* and 122*a* and outlet portions 121*b* and 122*b* are positioned on the outer peripheral surface 123. The respective inlet passages 111 and 112 of the spinning nozzle body 110 is formed so that outlet ports 111*a* and 112*a* are positioned to be opposite to the outer peripheral surface 123 of the operator 120 via the space portion 114. The nozzle passage 113 of the spinning nozzle body 110 is formed so that an inlet port 113*a* is positioned to be opposite to the outer peripheral surface 123 of the operator 120 via the space portion 114.

The operation of the configuration will now be described in detail. As illustrated in FIG. 4, if the heterogeneous resins having the different properties, for example, a resin A and a resin B, are supplied to the melting extruder 2 through the respective hopper 1, the resin A and the resin B are molted by the respective melting extruders 2, and then are supplied to the spinning nozzle unit 100.

Figure 6:
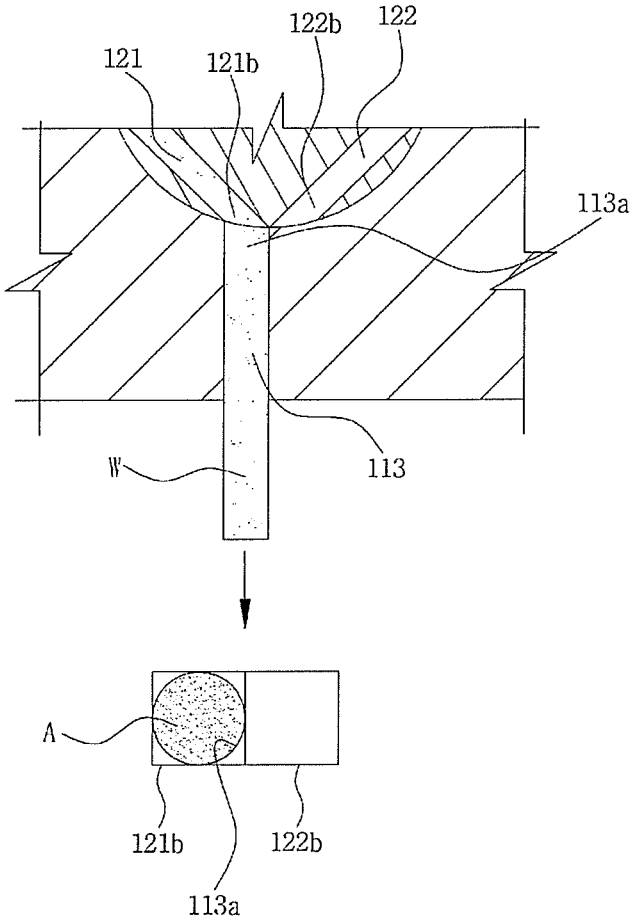

If the molten resins A and B are fed to the respective inlet passages 111 and 112 formed in the spinning nozzle body 110 of the spinning nozzle unit 100, as illustrated in FIGS. 5 and 6, the inlet port 121*a* and the outlet port 121*b* of the connecting passage 121 of the operator 120 for the resin A communicate with the outlet port 111*a* of the inlet passage 111 for the resin A and the inlet port 113*a* of the nozzle passage 113, and thus only the resin A is discharged through the nozzle passage 113.

Figure 7:
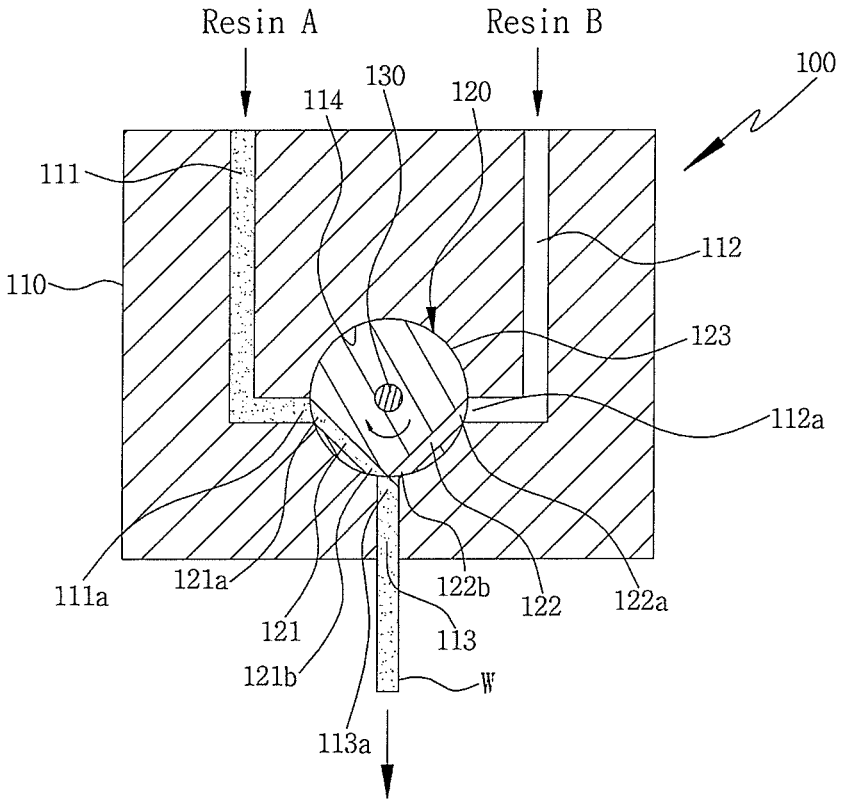
Figure 8:
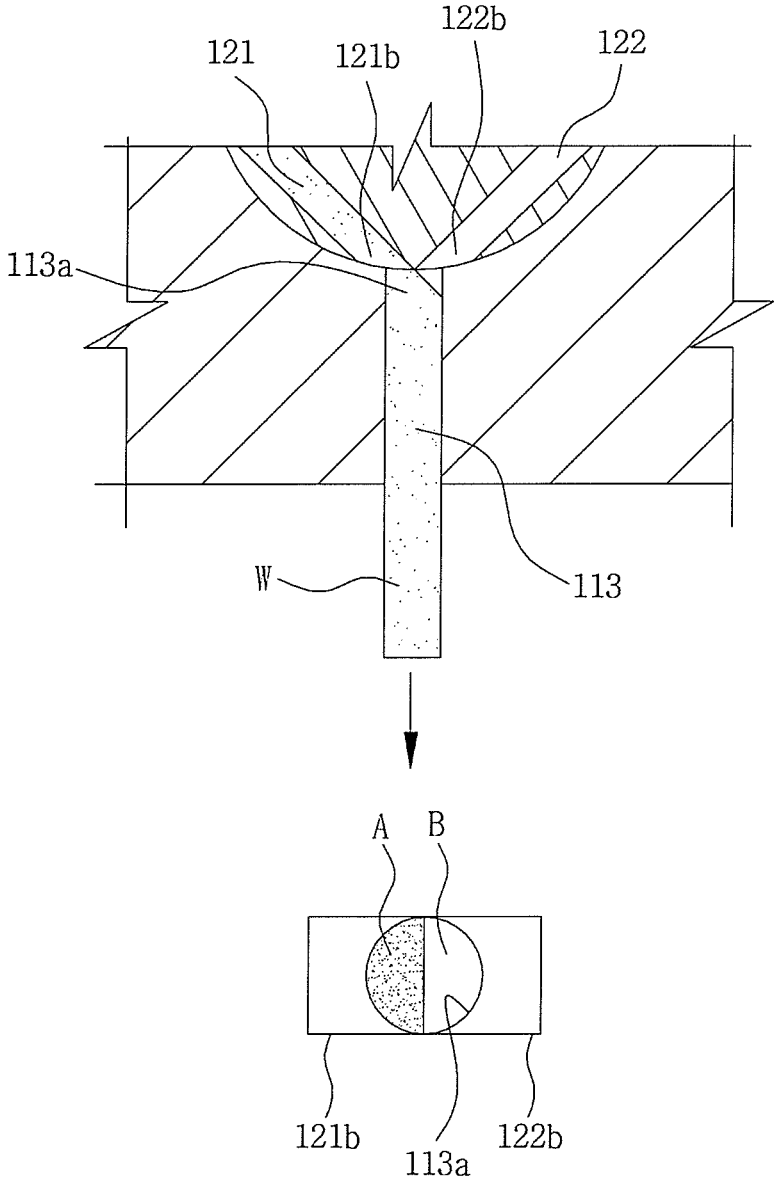

Then, if the operator 120 is rotated in an arrow direction (forward direction) by a given angle, as illustrated in FIGS. 7 and 8, the inlet portions 121*a* and 122*a* of the both connecting passages 121 and 122 of the operator 120 communicate with the outlet ports 111*a* and 112*a* of the inlet passages 111 and 112 for the resin A and the resin B and the inlet port 113*a* of the nozzle passage 113 by a half, respectively, and thus the resin A and the resin B are discharged half and half through the nozzle passage 113.

Figure 9:
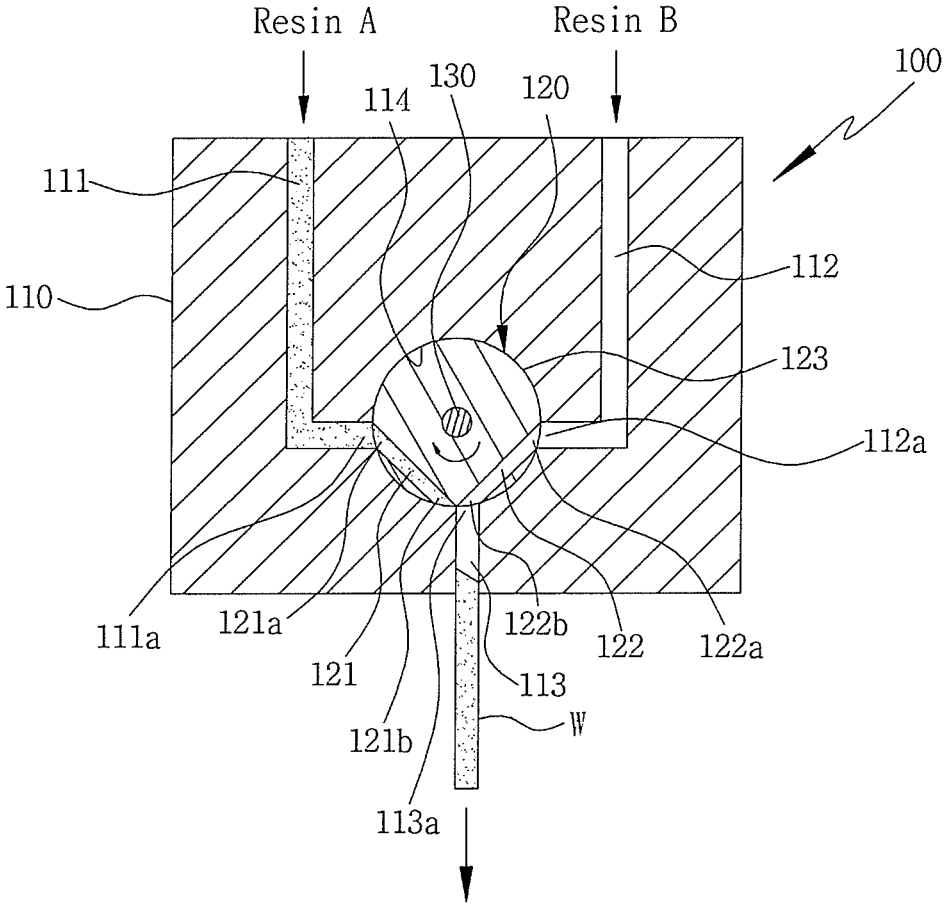
Figure 10:
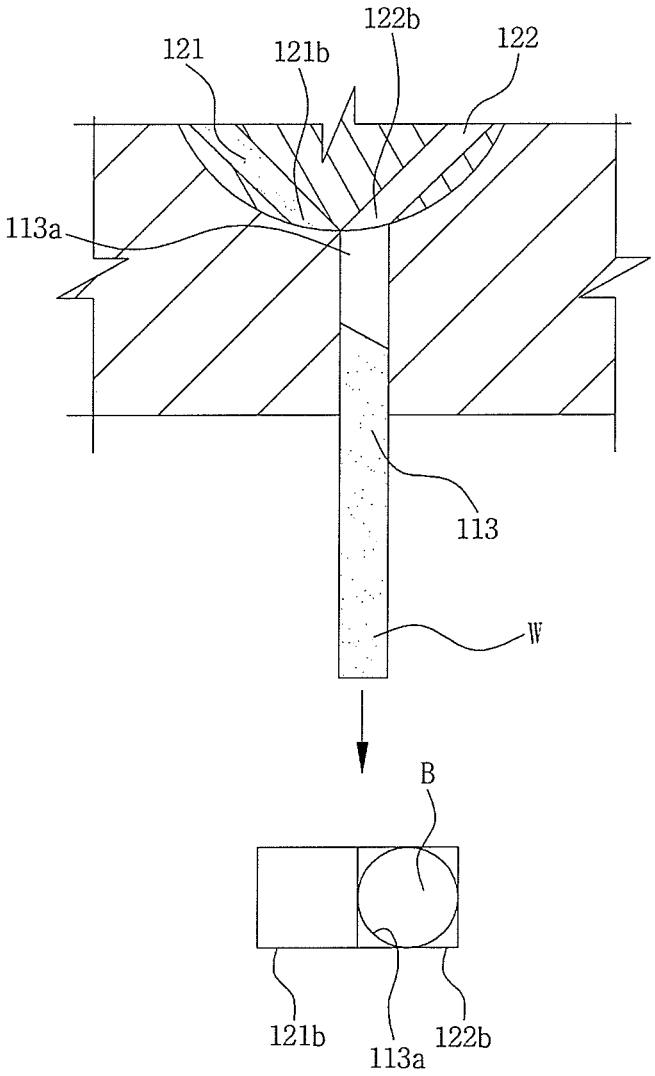

And, if the operator 120 is further rotated in the arrow direction (forward direction) by a given angle, as illustrated in FIGS. 9 and 10, the inlet port 121*a* and the outlet port 121*b* of the connecting passage 122 of the operator 120 for the resin B communicate with the outlet port 112*a* of the inlet passage 112 for the resin B and the inlet port 113*a* of the nozzle passage 113, and thus only the resin B is discharged through the nozzle passage 113.

Figure 11:
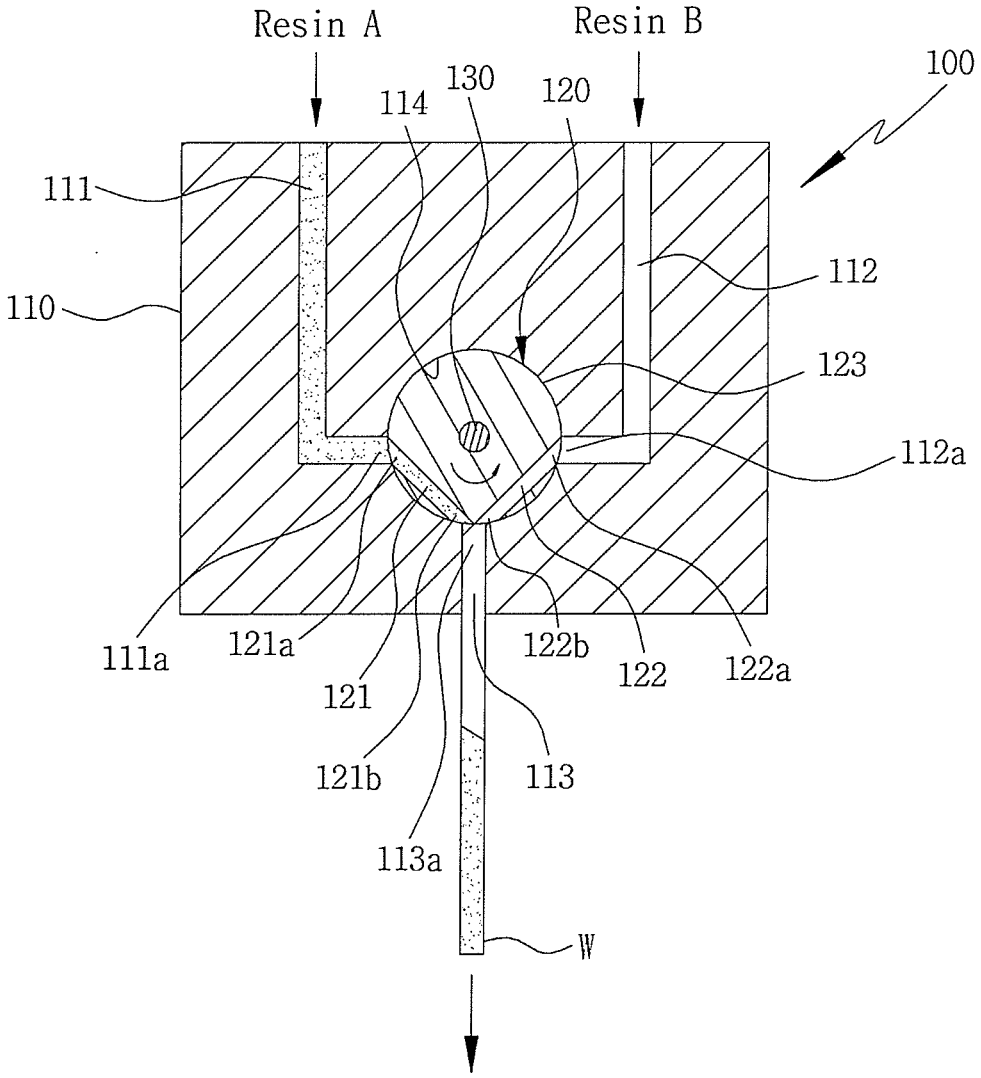
Figure 12:
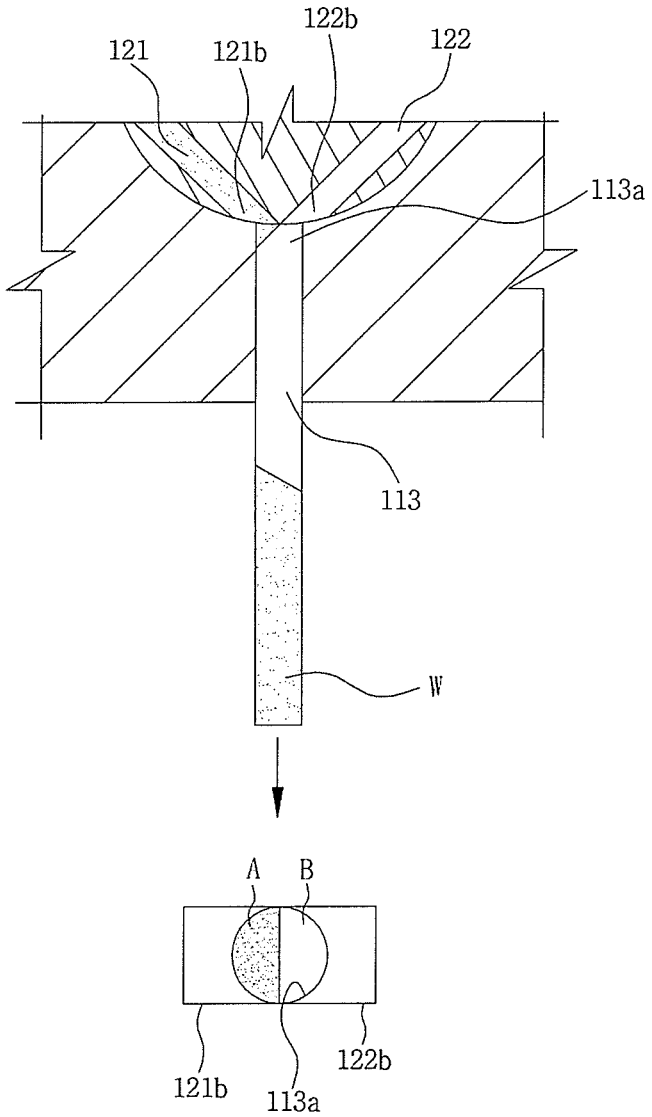

Then, if the operator 120 is rotated in an arrow direction (reverse direction) by a given angle, as illustrated in FIGS. 11 and 12, the inlet portions 121*a*, 122*a* and the outlet ports 121*b*, 122*b* of the both connecting passages 121 and 122 of the operator 120 communicate with the outlet ports 111*a* and 112*a* of the inlet passages 111 and 112 for the resin A and the resin B and the inlet port 113*a* of the nozzle passage 113 by a half, respectively, and thus the resin A and the resin B are discharged half and half through the nozzle passage 113.

Figure 13:
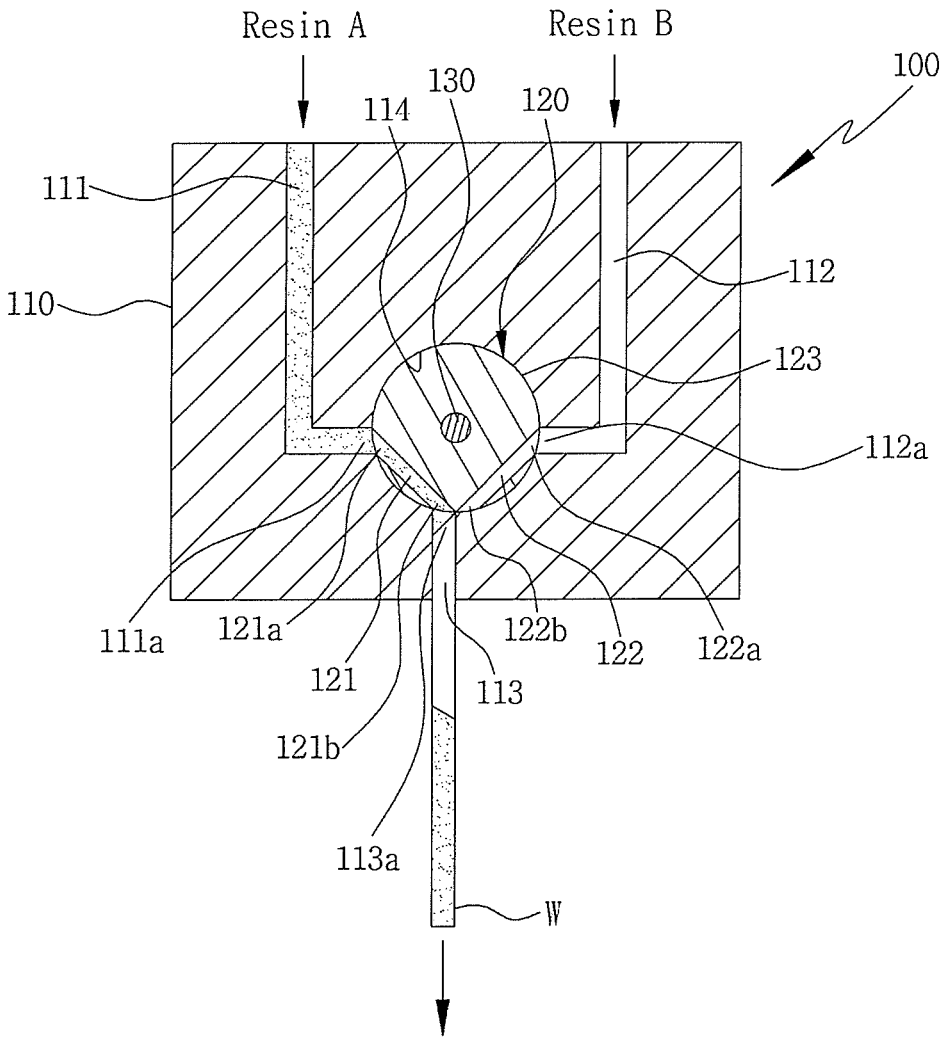
Figure 14:
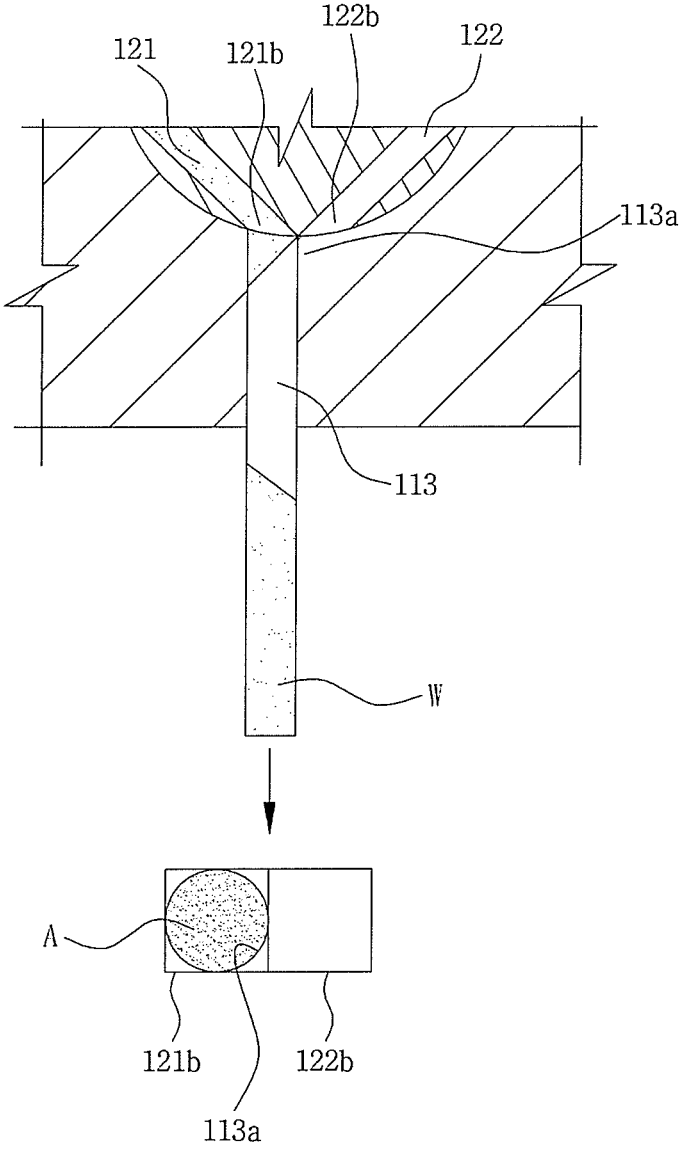

And, if the operator 120 is further rotated in the arrow direction (reverse direction) by a given angle, as illustrated in FIGS. 13 and 14, the inlet port 121*a* and the outlet port 121*b* of the connecting passage 121 of the operator 120 for the resin A communicate with the outlet port 111*a* of the inlet passage 111 for the resin A and the inlet port 113*a* of the nozzle passage 113, and thus only the resin A is discharged through the nozzle passage 113.

Figure 15:
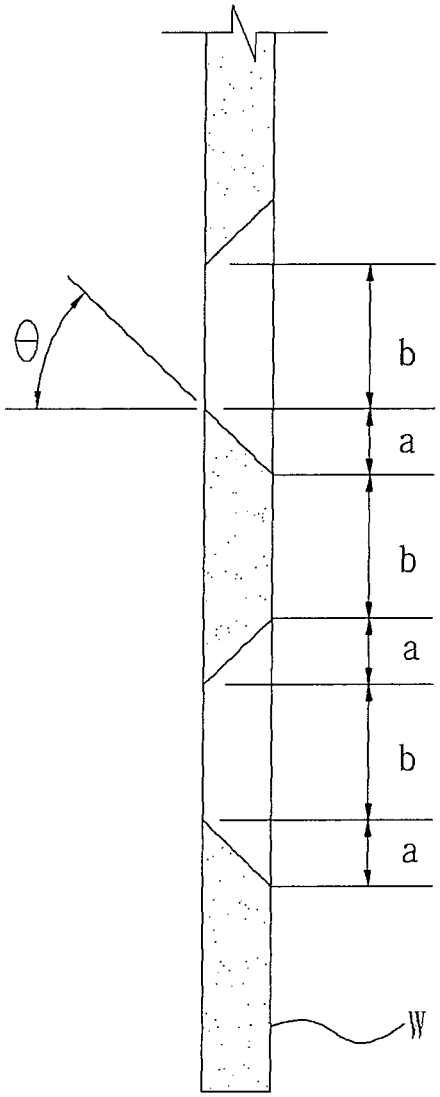
FIG. 15 is a front view schematically illustrating the conjugate fiber fabricated by the apparatus and method according to the present invention.

By repeatedly rotating the operator 120 in the forward and reverse directions, as illustrated in FIG. 15, the heterogeneous resins A and B having the different properties are alternatively fed in the longitudinal direction of the fiber W to fabricate the conjugate fiber.

In the conjugate fiber fabricated by the above method, mixed sections a of the resin A and the resin B, and continuous sections b of the resin A or the resin B are repeatedly formed in the longitudinal direction of the fiber W. A slope θ of the mixed section a is determined by adjusting the rotation speed (operating speed) of the operator 120, and a length of the continuous section b is determined by adjusting a delay time when a rotation direction is shifted.

Various surface effects and patters can be repeatedly formed in the longitudinal direction of the fiber W by adjusting the rotation speed and the delay time of the operator 120 and the length and diameter of the connecting passages 121 and 122. In addition, other surface effects and patterns can be formed by regularly or arbitrarily changing the rotation speed and the delay time of the operator 120.

In the conjugate fiber of the present invention fabricated by the above method, if resins (PET IV 0.65 and (VS) IV 0.75; PP MI 20 and MI 40; or the like), of which its material is equal but its molecular weight is different, or resins (PET and PBT; PET and PTT; Nylon6 and Nylon66; or the like) of similar series having different physical properties exist continuously in the longitudinal direction of the fiber W, its molecular orientation is continuously varied by elongation or spinning condition, thereby fabricating the conjugate fiber having various surface effects and patterns. In the case of dyeing, since a dyeing property is varied by the difference in orientation and degree of crystallinity, a two-tone dyeing effect can be obtained.

Also, even if the resins are of the same material, if resins of modified functions, such as a dyeing property, exist continuously in the longitudinal direction of the fiber W, the dyeing property is varied at the post-dyeing process, thereby obtaining the two-tone dyeing effect.

In addition, even if the resins are of the same material, if resins containing pigments exist continuously in the longitudinal direction of the fiber W, different colors exist in the longitudinal direction, thereby obtaining new two-tone dyeing effect.

Further, even if the resins are of the same material, if resins having different melting points exist continuously in the longitudinal direction of the fiber W, the fibers are woven and then fused due to the difference in melting point at the time of heat treatment, so that a fabric has a film effect.

Further, even if the resins are of the same material, if a resin of single component and a resin of composite component (e.g., a sheath-core type, a side-by-side, a sea-island type, or the like) exist continuously in the longitudinal direction of the fiber W, the functionality of the fiber can be improved by partial weight loss and removal through a weight loss process, as well as the effect improved by the use of dyeing property and pigment and the difference in molting point.

Meanwhile, if the resin of the same component or the different component containing different functional pigments or substances (common coloring pigment, UV-sensitized fluorescent pigment, IR-sensitized absorption pigment, X-rays absorption metal substance, and so forth) is used, a conjugate fiber of a security yarn function having different optical properties in the longitudinal direction of the fiber W can be fabricated.

Therefore, it is possible to fabricate a security yarn having heterogeneous optical properties in the longitudinal direction of the fiber by once process, of which an interface is uniform, without having inconveniences for secondary special dyeing or twisting after the conventional spinning. The process is simple, and the quality thereof is good. Also, it can be mass-produced to reduce a fabrication cost.

Since the length of the alternation in the longitudinal direction of the fiber can be easily adjusted by operating the spinning nozzle unit 100, the fiber can serve as a function of the security yarn having a specific pattern in the longitudinal direction of the fiber W.

Functional pigments and substances are put into the fiber by a master batch method to improve its durability under various circumstances such as color fastness to washing. In addition, the functional substance is not put into the resin, and heterogeneous polymer resins using different dyeing methods are used, or even if the resins are equal, the modified resins having different dyeing speed are mixed in the longitudinal direction to fabricate the conjugate fiber. After the conjugate fiber is dyed, a conjugate fiber can be fabricated of which colors are different in the longitudinal direction of the fiber W by a dyeing method and a dyeing difference of the polymer.

INDUSTRIAL APPLICABILITY

The present invention fabricates the conjugate fiber, of which the heterogeneous fibers having different properties are continuously and alternatively formed in the longitudinal direction of the fiber, by supplying the heterogeneous fibers having different properties to the spinning nozzle unit through the respective melting extruders, and continuously and alternatively discharging the respective molten resins, supplied from the respective melting extruders, from the spinning nozzle unit. In addition, the spinning nozzle unit includes the spinning nozzle body having the plurality of inlet passages which are fed by the molten resins supplied from the respective melting extruders, and the nozzle passage for discharging the molten resin, and the operator having the plurality of connecting passages for connecting the respective inlet passages with the nozzle passage and operating so that the respective connecting passages is alternatively connected with the nozzle passage.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

We claim:

1. An apparatus for fabricating a conjugate fiber, comprising:

a plurality of hoppers for supplying at least resins A and B having different properties;

a plurality of melting extruders for melting and extruding the resin supplied from the respective hoppers; and a spinning nozzle unit for feeding the molten resin supplied from the plurality of melting extruders to spin a fiber, wherein the spinning nozzle unit includes:

a spinning nozzle body having a plurality of inlet passages for feeding the molten resins supplied from the respective melting extruders, and a nozzle passage for discharging the molten resin to spin the conjugate fiber; and an operator having a plurality of connecting passages for connecting alternatively and continuously the respective inlet passages to the nozzle passage, wherein the operator is repeatedly and alternately rotated in clockwise or counterclockwise directions so that the conjugate fiber comprises alternately and continuously mixed sections of resins A and B and continuous sections of resin A or resin B, wherein said mixed sections have a slope θ; and wherein the slope θ of said mixed sections is determined by adjusting the rotation speed of the operator, and a length of the continuous sections is determined by adjusting a delay time when a rotation direction is shifted.

2. The apparatus for fabricating the conjugate fiber according to claim 1, wherein the operator is installed in the spinning nozzle body so as to alternately rotate in the clockwise or counterclockwise directions around a rotating shaft, wherein the operator has an outer peripheral surface centered on the rotating shaft;

an inlet port and an outlet port of the respective connecting passages are positioned on the outer peripheral surface;

an outlet port of the respective inlet passages and an inlet port of the nozzle passage are positioned to be opposite to the outer peripheral surface of the operator; and the inlet port and the outlet port of the respective connecting passages formed in the operator alternatively and continuously communicate with the outlet port of the respective inlet passages and the inlet port of the nozzle passage as the operator is alternately rotated in the clockwise counterclockwise directions.

3. A method for fabricating a conjugate fiber, wherein said method comprises the steps of:

providing an apparatus for fabricating a conjugate fiber as recited in claim 1;

supplying resins A and B having different properties to the spinning nozzle unit by the plurality of melting extruders; and continuously and alternatively discharging the respective molten resins supplied from the respective melting extruders by the spinning nozzle unit, thereby spinning the fiber having the mixed sections of resins A and B and the continuous sections of resin A or resin B, wherein said mixed sections have a slope θ, and wherein the slope θ of said mixed sections is determined by adjusting the rotation speed of the operator, and a length of the continuous sections is determined by adjusting a delay time when a rotation direction is shifted.

4. The method for fabricating the conjugate fiber according to claim 3, wherein the resins A and B having the different properties are the same or different resins including at least one selected from the group consisting of functional organic, inorganic, and metal substances so that the resins have different properties.

5. The method for fabricating the conjugate fiber according to claim 4, wherein the group consisting of functional organic, inorganic, and metal substances include at least one selected from the group consisting of a coloring pigment, a UV-sensitized fluorescent pigment, an IR-sensitized absorption pigment, an X-rays absorption metal substance, an antibiotic substance, a flame retardant substance, and a deodorizing substance.

* * * * *